US007528732B2

(12) United States Patent
Tajima et al.

(10) Patent No.: US 7,528,732 B2
(45) Date of Patent: May 5, 2009

(54) FIRE ALARM DEVICE AND METHOD

(75) Inventors: Yukinobu Tajima, Chiyoda-ku (JP); Hideki Yanagawa, Chiyoda-ku (JP); Naoki Urusibata, Chiyoda-ku (JP)

(73) Assignee: Pixen Inc., Tokyo (JP)

( * ) Notice: Subject to any disclaimer, the term of this patent is extended or adjusted under 35 U.S.C. 154(b) by 337 days.

(21) Appl. No.: 10/553,758

(22) PCT Filed: Apr. 21, 2004

(86) PCT No.: PCT/JP2004/005739

§ 371 (c)(1),
(2), (4) Date: Mar. 14, 2006

(87) PCT Pub. No.: WO2004/095387

PCT Pub. Date: Nov. 4, 2004

(65) Prior Publication Data

US 2006/0290522 A1 Dec. 28, 2006

(30) Foreign Application Priority Data

Apr. 23, 2003 (JP) ..... 2003-118556

(51) Int. Cl.
*G08B 17/12* (2006.01)

(52) U.S. Cl. ..... 340/577; 340/638; 340/632; 422/120

(58) Field of Classification Search ..... 340/577, 340/628, 632; 422/110, 120, 123; 261/26
See application file for complete search history.

(56) References Cited

U.S. PATENT DOCUMENTS 5,591,409 A * 1/1997 Watkins ..... 422/110
5,642,092 A * 6/1997 Dunne et al. ..... 340/326
6,881,382 B2 * 4/2005 Goldstein et al. ..... 422/123

* cited by examiner

*Primary Examiner*—Davetta W Goins
(74) *Attorney, Agent, or Firm*—Oliff & Berridge, PLC

(57) ABSTRACT

A fire alarm device and method capable of informing people with visual and hearing difficulties of occurrence of fire. A fire detection means (1) detecting the occurrence of fire is connected to an emission control means (4). A smell emitting means (9) activated by the emission control means 4 is also connected to the emission control means (4). The fire detection means (1) activates the emission control means (4) when detecting the occurrence of fire. The emission control means (4) is provided with a smell condition-setting means so as to set starting time for continuously-emitted smell, and to set emission periods, emission intervals and emission concentrations for intermittently-emitted smell. The smell emitting means (9) will be activated in accordance with the conditions set by the smell condition-setting means.

3 Claims, 4 Drawing Sheets

FIRE ALARM DEVICE AND METHOD

FIELD OF THE INVENTION

The present invention relates to a fire alarm device and method, and the present invention particularly relates to a fire alarm device and method that are effective for people with visual and hearing difficulties.

BACKGROUND OF THE INVENTION

As conventional fire alarm devices, fire alarm devices such as a fire sensor for detecting heat, smoke, gas, light of flame and the like generated by a fire, and the like are known. Fires have been determined using such fire alarm devices independently, or combining them to prevent false alarms. Further, a bell or the like is rung according to a detected signal, and at the same time, a sprinkler or the like is activated. These fire alarm devices, however, have not been effective for people with visual and hearing difficulties.

Moreover, a gas fire-extinguishing system extinguishes fire after closing a fire target area when extinguishing fire. Accordingly, the area is filled with hazardous gas after extinguishing the fire. Thus, entering the area without necessary preparation is dangerous. In order to prevent danger like this, a smelling substance injection device used in a gas fire-extinguishing system is disclosed (See Japanese Patent Laid-Open Publication No. Hei 6-79012, for example.). In the smelling substance injection device, a smelling substance is mixed into a fire-extinguishing gas and then emitted so that its smell gives people a warning not to enter the area. This device is coupled to a fire-extinguishing gas supply pipe, and includes an inlet for a liquid chemical of the smelling substance, a liquid chemical bath, a high pressure gas cylinder, and a piston having a tip provided with a cutter. In the device, the piston is moved by gas pressure, a sealing plate for a cylinder opening and the cylinder are opened by the cutter, the pressurized gas in the cylinder is introduced to the liquid chemical bath, a sealing plate for an exit is opened by the pressurized gas, and the liquid chemical flows from the liquid chemical inlet to the gas supply pipe so that the liquid chemical is mixed into the fire-extinguishing gas. The device is designed so that a smelling substance is mixed into a fire-extinguishing gas and then emitted, and its purpose is to eliminate the danger of entering the area without necessary preparation after using the gas fire-extinguishing system. This is also applicable for people other than people with visual and hearing difficulties. The device, however, does not inform people of an occurrence of fire in case of fire.

The following devices are referred to as means for solving the above described problem, that is, people with visual and hearing difficulties cannot be informed of an occurrence of fire in case of fire. As a device that can warn people with visual difficulties, there has been a fire alarm device that generates a bell sound. Further, for people with hearing difficulties, a warning device is disclosed which emits, for example, odor to inform them of an emergent situation such as a fire (See Japanese Patent Laid-Open Publication No. Hei 06-76179, for example.). In such a warning device that emits odor, when sensor means detects an abnormality, current flows through circuit means so as to melt a fuse. At this time, an odor bag provided in the fuse is broken by melting heat, thereby emitting the odor. Moreover, when the sensor means detects abnormality, current flows through the circuit means to melt the fuse, and then a pin member operates to break the odor bag, thereby emitting the odor.

However, the conventional fire alarm device that utilizes a bell sound only generates the bell sound, so that people with visual difficulties cannot be informed of an evacuation route. Meanwhile, the above-described warning device that emits odor can inform people with visual difficulties of an occurrence of fire, however, it is configured such that, when the sensor means detects abnormality, a fuse is melted and the odor is emitted. Therefore, timing for emitting the odor is primarily determined by a fuse melting time. In addition, the odor is a single odor. However, there are various situations in which a fire occurs, such as a fire during sleep, a fire in which an evacuation route is not found due to smoke generation, and the like. Accordingly, it is not preferable that the timing for emitting a smell or odor be primarily determined. In addition, there are various conditions for a human body to respond to a smell or odor. For example, smells of flowers and plants cannot help a human body to get up, but an after-fire odor or a fire smell can force a human body to get up. Therefore, a fire alarm device and a fire alarm method are expected which give warning of fire according to a fire occurrence situation, as well as a condition to which a human body responds.

To solve the foregoing problems, it is an object of the present invention to provide a fire alarm device and method capable of informing also people with visual and hearing difficulties of an occurrence of fire.

DISCLOSURE OF THE INVENTION

In order to achieve the above object, a fire alarm device as set forth in a first embodiment of the present invention includes: emission control means activated by a signal from fire detection means that detects an occurrence of fire; and smell-emitting means activated by the emission control means. The fire alarm device is characterized in that the emission control means includes smell condition-setting means that sets an emission start time of smell to be continuously emitted, or sets an emission time period, emission intervals, and an emission concentration of smell to be intermittently emitted, and the emission control means activates the smell-emitting means according to a smell condition set by the smell condition-setting means.

The fire alarm device as set forth in a second embodiment is characterized in that, in the fire alarm device according to the first embodiment, the smell-emitting means includes a high-pressure gas cylinder having a gas injection orifice provided with a solenoid valve, and opens the solenoid valve based on a signal from the emission control means so as to emit smell.

The fire alarm device as set forth in a third embodiment is characterized in that, in the fire alarm device according to the first embodiment, the smell-emitting means starts rotational motion based on a signal from the emission control means, and is a screw-type smell-emitting means which is formed such that an air pressure gradually increases towards an injection opening provided with a smell-emitting substance, and which converts rotational motion to air compression. The fire alarm device as set forth in a fourth embodiment is characterized in that, in the fire alarm device according to the first embodiment, the smell-emitting means includes: a hemispherical container provided with a smell-emitting substance; and a smell-emitting opening that is opened according to a signal from the emission control means, and the smell-emitting means is placed on the ceiling.

The fire alarm device as set forth in a fifth embodiment is characterized in that, in the fire alarm device according to a first embodiment, the smell-emitting means includes a smell-emitting substance provided with a heating element that is heated based on a signal from the emission control means, and diffusing means for diffusing smell emitted by heat generation of the heating element.

The fire alarm device as set forth in a sixth embodiment is characterized in that, in the fire alarm device according to any one of the first through fifth embodiments, the smell-emitting means are provided along an evacuation route with a space therebetween.

A fire alarm method as set forth in a seventh embodiment is characterized in that smell-emitting means are provided along an evacuation route with a space therebetween, and when a fire occurs, emission control means, which is activated based on a signal from fire detection means, controls to activate the smell-emitting means from one placed in a vicinity of a spot of the fire and gradually towards an evacuation exit, so as to emit smell from the smell-emitting means and thereby giving warning of fire.

A fire alarm method as set forth in an eighth embodiment is characterized in that, when a fire occurs, emission control means, which is activated based on a signal from fire detection means, activates smell-emitting means that emits an awakening smell so as to emit the smell, and then activates smell-emitting means that emits an irritating smell so as to emit the smell, thereby giving warning of fire.

A fire alarm method as set forth in a ninth embodiment is characterized in that smell-emitting means are provided along an evacuation route with a space therebetween, and when a fire occurs, emission control means, which is activated based on a signal from fire detection means, controls to activate the smell-emitting means intermittently so as to emit smell such that, in an initial stage of the intermittent operation, emission intervals are long and an emission time period is short, and then as time elapses, the emission intervals are reduced and the emission time period is increased gradually, thereby giving warning of fire.

DETAILED DESCRIPTION OF THE EMBODIMENT

Figure 1:
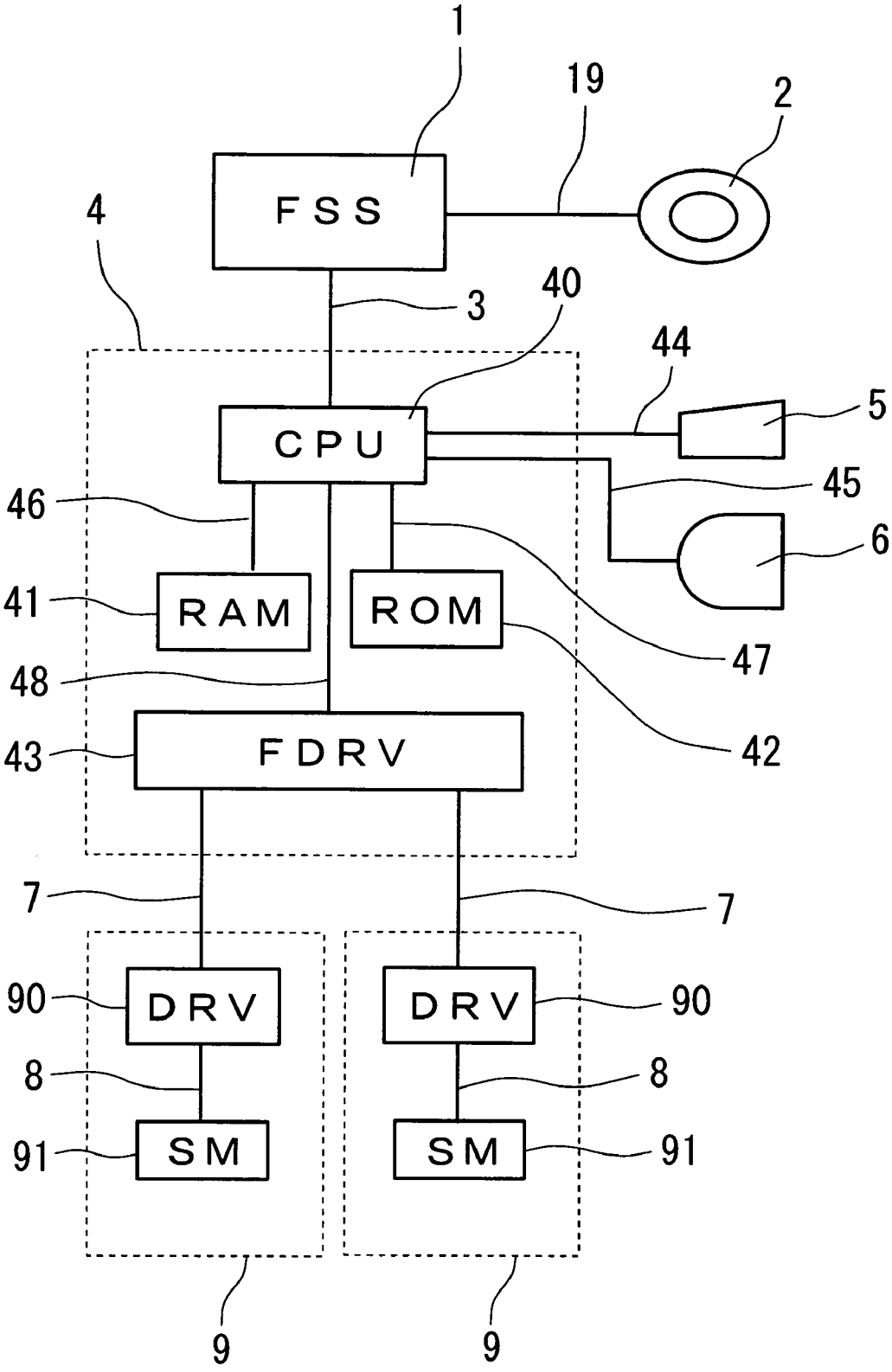
FIG. 1 is a block diagram showing a configuration of a fire alarm device.

A fire alarm device of the present invention will be described with reference to FIG. 1. Fire detection means 1, to which a fire alarm bell 2 is connected via a signal wire 19, is connected to emission control means 4 for controlling smell emission, via a signal wire 3. Smell emitting means 9 activated by the emission control means 4 is connected to the emission control means 4 via a signal wire 7. The emission control means 4 includes a microcomputer (CPU) 40, a RAM 41, a ROM 42, and a driving circuit 43 for driving the smell-emitting means 9. A keyboard 5 and a display 6 are connected to the CPU 40 via signal wires 44 and 45, respectively. The smell-emitting means 9 is connected to the driving circuit 43 via the signal wire 7. The RAM 41, the ROM 42 and the driving circuit 43 are connected to the CPU 40 via signal wires 46, 47 and 48, respectively.

The ROM 42 stores a program for activating the fire alarm device, while the RAM 41 stores data necessary for activating the fire alarm device. The keyboard 5 serves as data input means for inputting conditions for activating the fire alarm device. The display 6 is a display unit for confirming a status of the fire alarm device and input data. The keyboard 5 is provided to serve as smell condition-setting means for setting a smell emitting state (i.e., a state where smell is continuously emitted, or a state where smell is intermittently emitted), an emission start time, emission intervals, an emission concentration, and the like. Data input from the condition-setting means is stored in the RAM 41, and utilized by the CPU 40 as necessary.

Figure 2:
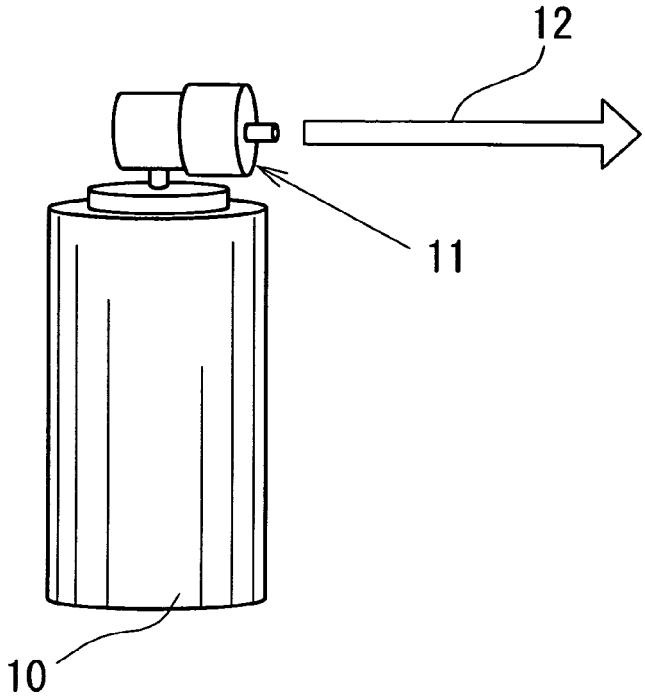
FIG. 2 shows a first embodiment of smell-emitting means.
Figure 3:
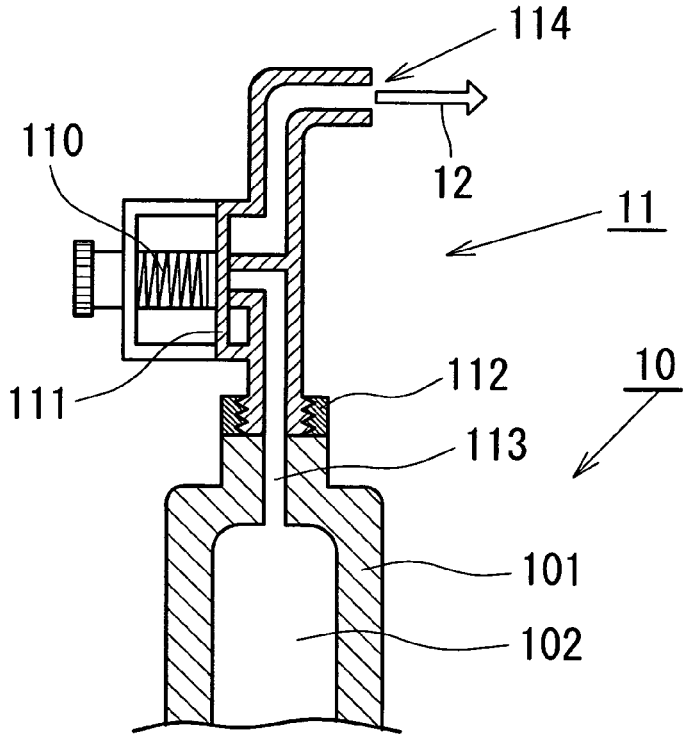
FIG. 3 is a partial enlarged view of FIG. 2.

The smell-emitting means 9 is configured with smell generation control means 90 and smell-generating means 91. The smell generation control means 90 is connected to the emission control means 4 via the signal wire 7. Further, the smell generation control means 90 is connected to the smell-generating means 91 via a signal wire 8. The smell generation control means 90 may be a one-chip microcomputer, for example, or another control means, and embodiments thereof will be specifically described later with reference to FIGS. 2 to 6. In FIG. 2, the smell-emitting means 9 is configured with a solenoid valve 11 that is provided on an injection orifice of a high-pressure gas cylinder 10 to serve as the smell generation control means 90, and the high-pressure gas cylinder 10 which serves as the smell-generating means 91, and in which a smell-emitting substance 102 is contained together with a high-pressure gas. Thus, a smell 12 is emitted to the outside at the time of injection of the high-pressure gas. The smell-emitting means 9 with the above configuration is suitable when placed on the floor or hung on the wall. As shown in FIG. 3, the solenoid valve 11 is configured such that a force of an electromagnet (not shown) moves a plunger 111 to open a passage so that air, liquid, powder and the like are allowed to pass therethrough, and then a reaction force of a spring 110 restores the plunger 111 to close the passage. In this case, the solenoid valve 11 is connected to a high-pressure cylinder 10 in which the smell-emitting substance is contained, thereby forming the smell-emitting means 9. The solenoid valve 11 is connected with the high-pressure cylinder 10 at a screw portion 112. When the solenoid valve 11 operates to move the plunger 111, a passage communicating between an outlet 113 of the high-pressure cylinder 10 and an injection opening 114 is ensured, and the smell 12 is emitted to the outside at the time of injection of the high-pressure gas. The solenoid valve 11 may be connected to the high-pressure cylinder 10 in another manner, and a fixing pin may be fixed to a sealing clamp for sealing the gas in the high-pressure cylinder 10, for example.

Figure 4:
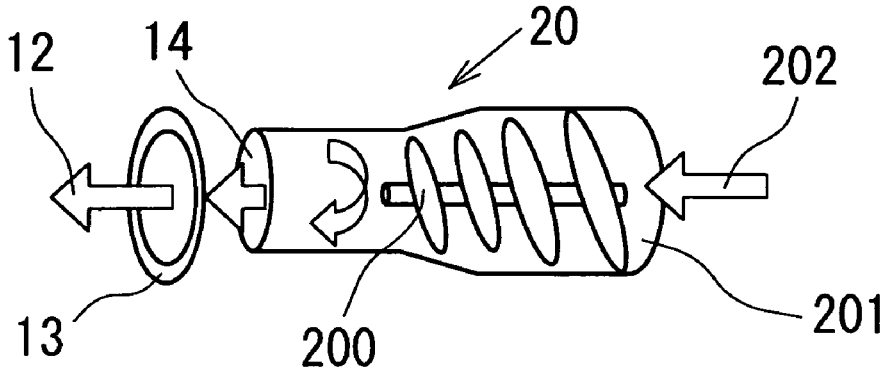
FIG. 4 shows a second embodiment of the smell-emitting means.

In FIG. 4, the smell-emitting means 9 is configured with a screw-type air compressor 20 (provided to serve as the smell generation control means), and a smell-impregnated material 13 (smell-generating means) provided at an outlet of the screw-type air compressor 20. The smell-emitting means 9 with the above configuration is suitable for being provided on the wall, between pillars, in the window, and the like in the case where space to provide the device is not available on the floor. A case 201 of the screw-type air compressor 20 tapers off to an outlet 14, and accordingly the size of a fan 200 also becomes small. The rotational motion of a motor or the like is transmitted as rotation of the fan 200, an air 202 is taken in, and a flow of the air is such that the air is compressed to the fullest extent at the outlet 14 to become a high-pressure air, and then flows out. The smell-impregnated material 13 is provided at the outlet 14, and the smell 12 is injected to the outside. The fan 200 rotates according to a signal from the above-described emission control means 4, and the compressed air hits against the smell-impregnated material 13, thereby injecting the smell. Note that, regarding the providing method of the smell-impregnated material 13, the smell-impregnated material 13 may be provided so as to be tightly fixed to the outlet 14 of the case 201, or may be provided away from the outlet 14 of the case 201 using supporting means (not shown).

Figure 5:
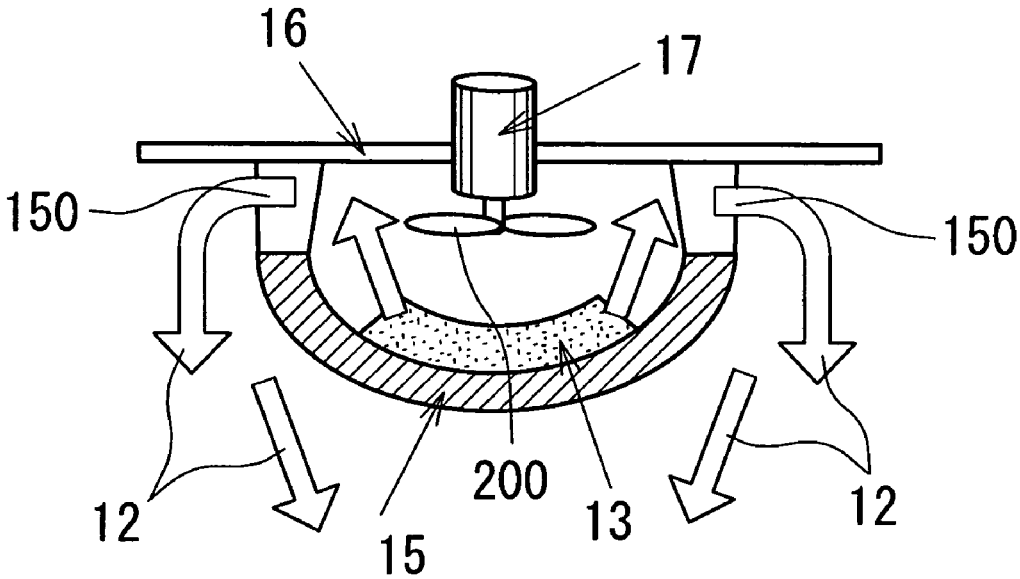
FIG. 5 shows a third embodiment of the smell-emitting means.

In FIG. 5, the smell-emitting means 9 is configured with the fan 200 rotated by rotation of a motor 17 mounted in a ceiling portion 16 which is provided to serve as the smell generation control means 90, and a smell-emitting substance 13 that is provided in a hemispherical container 15 to serve as the smell-generating means. Spraying smell from the ceiling portion 16 is suitable for ensuring an evacuation route in case of fire. Further, a smell component is likely to have a large specific gravity compared to the atmosphere, so that the ceiling is suitable as a providing place. The hemispherical container 15 has smell-emitting openings 150 that are opened according to a signal from the above-described emission control means 4 in order to prevent the smell component from spontaneously diffusing to the outside. The motor 17 starts to rotate when the smell-emitting openings 150 are opened according to the signal from the emission control means 4, and the fan 200 sprays the smell-emitting substance 13 from the ceiling portion 16.

Figure 6A:
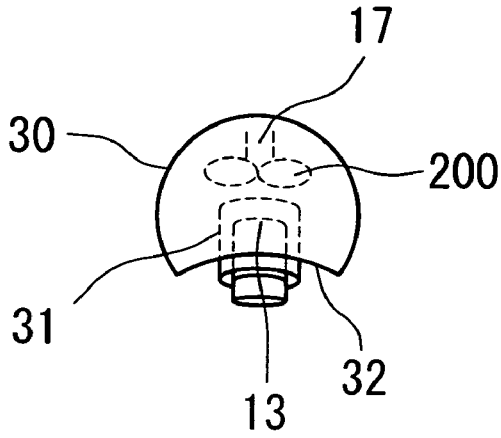
FIGS. 6A and 6B show a fourth embodiment of the smell-emitting means.
Figure 6B:
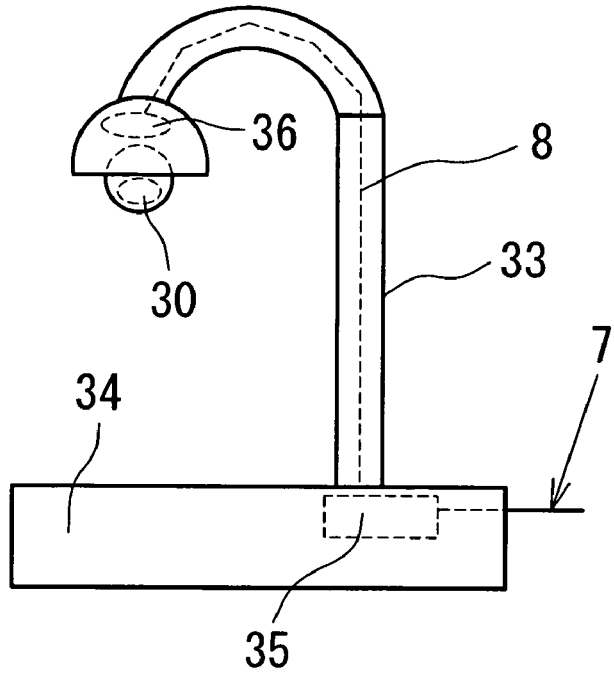

In FIG. 6, the smell-emitting means 9 is designed to surely transmit smell even during sleep. As shown in FIG. 6(*a*), the smell-emitting means 9 is configured with: the fan 200 rotated by the motor 17 mounted in a container 30 which is provided as a part of the smell generation control means 90; a heating element 13 provided as the smell-generating means; and a smell-impregnated material 31 provided in such a manner that it winds around the heating element 13. The smell generation control means is configured with the fan 200 rotated by the motor 17 mounted in the container 30, and a control circuit 35. The container 30 is formed with a window 32 to emit smell. Further, as shown in FIG. 6(*b*), the container 30 is arranged near a bulb 36 provided in a lamp stand 34, and smell is surely transmitted, for example, even during sleep. In this case, as a smell impregnated in the smell-impregnated material 31, a smell of methyl mercaptan, a faint ammonia material or the like is preferable. Meanwhile, in the case where two or more types of aroma chemicals are prepared, it is preferable to use, on one hand, a smell of peppermint or spearmint, rosemary, eucalyptus, lemongrass or the like, or an aroma chemical prepared by mixing them.

When the control circuit 35 is activated based on a signal from the emission control means via the signal wire 7, and the fan 200 is rotated via the signal wire 8, current is applied to the heating element 13, whereby the smell-impregnated material 31 surrounding the heating element 13 is heated to emit smell. Note that it is also applicable that a heat-fractured material is wound around the smell-impregnated material 31 so that aroma flows to the outside when the material is fractured by heat applied thereto. In this case, other than the heating element 13, heat of a lamp such as a normally used incandescent lamp may be used. Further, the lamp may be lit by the control circuit 35.

Note that, as the smell-impregnated material shown in FIGS. 4 to 6, an EVA plastic open-cell foam, a polyethylene open-cell foam, and the like are preferable. However, a metal material as well as a plastic material is applicable as long as it is a porous material that can retain smell inside thereof.

Next, an operation of FIG. 1 will be described. A plurality of smell-emitting means 9 are arranged along an evacuation route with a space therebetween. A smell emitting state (i.e., a state where smell is continuously emitted, or a state where smell is intermittently emitted), an emission start time, emission intervals, an emission concentration, and the like, which are input from the keyboard 5 serving as the smell condition-setting means, are stored in the RAM 41 by the CUP 40 serving as the emission control means 4. The data stored in the RAM 41 is confirmed by the display 6, and if there is a mistake, data is input again. When an occurrence of fire is informed by the fire detection means 1 via the signal wire 3, the emission control means 4 controls the smell-emitting means 9 in the following manner, based on the data stored in the RAM 41.

First, description will be made for the case where the smell emitting state is set to a state where smell is continuously emitted. The plurality of smell-emitting means 9 that are arranged along the evacuation route with a space therebetween may be set such that their emission start times are set to the same time, or to different times. When the emission start times are set to the same time, many people other than people with visual and hearing difficulties in an environment where bell sound is not heard, for example, in a noisy place, a place where a bell is not provided, or the like, can also know an occurrence of fire. Meanwhile, when the emission start times are set to different times, the smell-emitting means 9 are gradually activated towards an evacuation exit from one placed in the vicinity of the spot of the fire which is obtained from the fire detection means 1 via the signal wire 3. In this manner, the smell-emitting means 9 are activated with time differences. Thus, people with visual difficulties who cannot evacuate speedily can sense the emitted smell that remains as they approach the evacuation exit.

When an occurrence of fire is informed from the fire detection means 1 via the signal wire 3, the CPU 40 serving as the emission control means 40 reads out the data stored in the RAM 41, and controls the smell-emitting means 9. When the emission start times are set to the same time, the CPU 40 sends a signal to the smell-emitting means 9 via the driving circuit 43 to activate all the smell-emitting means 9. Meanwhile when the emission start times are set differently, the CPU 40 sends a signal to the smell-emitting means 9 via the driving circuit 43 to activate the smell-emitting means 9 from one placed in the vicinity of the spot of the fire. When the smell-emitting means 9 receives the signal from the emission control means 4, the smell generation control means 90 is activated to emit smell from the smell-generating means 91.

Next, description will be made for the case where the smell emitting state is set to a state where smell is intermittently emitted. The plurality of smell-emitting means 9 that are arranged along the evacuation route with a space therebetween may be set such that their emission start times are set to the same time, or to different times. Even in the case where the smell emitting state is set to a state where smell is intermittently emitted, the order in which the plurality of smell-emitting means 9 are activated is the same as in the case where they are set such that smell is continuously emitted. When the smell emitting state is set such that smell is intermittently emitted, the CPU 40 serving as the emission control means 4 reads out the data on the emission interval and the emission concentration which is stored in the RAM 41, and controls the smell-emitting means 9 in the following manner.

Although a smell concentration is determined based on a material decided in advance, when smell is emitted to the air, the concentration is determined based on an emitted amount. The CPU 40, therefore, reads out the data on the emission concentration, and determines the emission concentration in the air, that is, an emission time period to be 0.1 to 5 seconds, for example, for each of the smell-generating means 91 provided in the smell-emitting means 9 that is placed. Further, intervals of the emission time period are set such that the emission intervals in an initial stage are long, and then gradually reduced. As a result, this works to emphasize the degree of danger, which is effective in encouraging people to evacuate rapidly. Moreover, in the initial stage, the emission intervals are made long, and in addition, the emission concentration is made small, that is, the emission time period is made short. Thus, in case of a malfunction of the fire detection means 1 or the like, it is possible to minimize damage to the fire alarm device as well as to the environment.

Hereinafter, a first fire alarm method using the fire alarm device shown in FIG. 1 will be described. The plurality of smell-emitting means 9 are arranged along the evacuation route with a space therebetween. A place where the smell-emitting means 9 is provided, a type of the smell-emitting means 9, a smell emitting state (i.e., a state where smell is continuously emitted, or a state where smell is intermittently emitted), an emission start time, emission intervals, an emission concentration, and the like are input from the keyboard 5 serving as the smell condition-setting means. When a fire occurs, the emission control means 4 is activated by a signal from the fire detection means 1. The emission control means 4 determines the order in which smell is generated, a smell emission time period, and emission intervals based on data on the place where the smell-emitting means 9 is provided, the smell emitting state (i.e., the state where smell is continuously emitted, or the state where smell is intermittently emitted), the emission start time, the emission intervals, the emission concentration and the like, which are input from the keyboard 5, and the type of the smell-emitting means 9 provided. The emission control means 4 controls to activate the smell-emitting means 9 from one placed near the spot of the fire and gradually towards the evacuation exit, so as to emit smell from the smell-emitting means and thereby warn people of fire.

Next, a second fire alarm method using the fire alarm device shown in FIG. 1 will be described. The smell-emitting means 9 is provided in a bedroom and the like. A place where the smell-emitting means 9 is provided, a type of the smell-emitting means 9, a smell emitting state (i.e., a state where smell is continuously emitted, or a state where smell is intermittently emitted), an emission start time, emission intervals, an emission concentration, and the like are input from the keyboard 5 serving as the smell condition-setting means. When a fire occurs, the emission control means 4 is activated by a signal from the fire detection means 1. Based on the data input from the keyboard 5 about the place where the smell-emitting means 9 is provided, the smell emitting state (i.e., the state where smell is continuously emitted, or the state where smell is intermittently emitted), the emission start time, the emission intervals, the emission concentration and the like, and the type of the smell-emitting means 9 provided, the emission control means 4 first activates the smell-emitting means 9 that emits an awakening smell so as to emit the smell. Then, the emission control means 4 controls to stop the awakening smell and activate the smell-emitting means 9 that emits an irritating smell so as to emit the smell, thereby giving warning of fire. Note that the irritating smell may be emitted without stopping the awakening smell.

Next, a third fire alarm method using the fire alarm device shown in FIG. 1 will be described. A place where the smell-emitting means 9 is provided, a type of the smell-emitting means 9, a smell emitting state (i.e., a state where smell is continuously emitted, or a state where smell is intermittently emitted), an emission start time, emission intervals, an emission concentration, and the like are input from the keyboard 5 serving as the smell condition-setting means. When a fire occurs, the emission control means 4 is activated by a signal from the fire detection means 1. Based on the data input from the keyboard 5 about the place where the smell-emitting means 9 is provided, the smell emitting state (i.e., the state where smell is continuously emitted, or the state where smell is intermittently emitted), the emission start time, the emission intervals, the emission concentration and the like, and the type of the smell-emitting means 9 provided, the emission control means 4 activates the smell-emitting means 9 intermittently such that the emission intervals are controlled to be long and the emission time period is controlled to be short in an initial stage of the intermittent operation, and then as time elapses, the emission intervals are gradually controlled to be reduced and the emission time period is controlled to be increased, thereby emitting smell and giving warning of fire.

Further, in the third fire alarm method, if the plurality of smell-emitting means 9 are arranged along an evacuation route with a space therebetween, as described in the first fire alarm method, the smell-emitting means 9 placed near the spot of the fire is first activated, and then the smell-emitting means 9 are gradually activated towards the evacuation exit, whereby smell is emitted from the smell-emitting means. At the same time, the respective smell-emitting means 9 are activated intermittently such that the emission intervals are controlled to be long and the emission time period is controlled to be short in the initial stage of the intermittent operation, and then as time elapses, the emission intervals are gradually controlled to be reduced and the emission time period is controlled to be increased, thereby emitting smell and giving warning of fire.

Although FIG. 1 illustrates that one fire detection means 1 for detecting an occurrence of fire is connected to the emission control means 4 for controlling smell emission, a plurality of fire detection means 1 may be connected to the emission control means 4. Alternatively, the fire detection means 1 may be one with multiple functions which transmits a fire situation and the like according to the progress of the fire. In such a case, the emission control means 4 is designed to interpret signals from the fire detection means 1 with multiple functions, and appropriately select a smell emitting state (i.e., a state where smell is continuously emitted, or a state where smell is intermittently emitted), an emission start time, emission intervals, an emission concentration, and the like. Meanwhile, in the case where the plurality of fire detection means 1 are connected, the emission control means 4 activates the smell-emitting means that is placed in the vicinity of the fire detection means 1 that has transmitted a fire alarm signal. In this case, data on a place where the fire detection means 1 is provided and its positional relationship with the smell-emitting means is stored in advance in the RAM 41 or the ROM 42 in the microcomputer (CPU) 40 of the emission control means 4.

INDUSTRIAL APPLICABILITY

A fire alarm device as set forth in the first embodiment includes emission control means activated by a signal from fire detection means that detects an occurrence of fire, and smell-emitting means activated by the emission control means. In the fire alarm device, the emission control means includes smell condition-setting means that sets an emission start time of smell to be continuously emitted, or sets an emission time period, emission intervals, and an emission concentration of smell to be intermittently emitted, and the emission control means activates the smell-emitting means according to a smell condition set by the smell condition-setting means. As a result, according to various fire situations, the emission control means enables a corresponding type of the smell-emitting means in their various types to generate continuously emitted smell or intermittently emitted smell. Further, by providing the emission control means, it is possible to activate various types of smell-emitting means according to various fire situations. Thus, it is possible to rapidly inform also people with visual and hearing difficulties of an occurrence of fire.

In the fire alarm device as set forth in any one of the second through fifth embodiments, the smell-emitting means can be appropriately selected according to an environment where the smell-emitting means is placed, a situation in which the smell-emitting means is used, and the like. In addition, by being controlled by the emission control means, the smell-emitting means can be activated corresponding to various fire situations and its use environment, for example, even during sleep. Thus, it is possible to rapidly give warning of fire.

In the fire alarm device as set forth in the sixth embodiment, the smell-emitting means are provided along an evacuation route with a space therebetween. Thus, it is possible to rapidly give warning of fire. In addition, people without knowledge about an evacuation route in a building or the like can know the evacuation path. This is effective to reduce damage in case of fire.

In a fire alarm method as set forth in the seventh embodiment, smell-emitting means are provided along an evacuation route with a space therebetween, and when a fire occurs, emission control means, which is activated based on a signal from fire detection means, controls to activate the smell-emitting means from one placed in a vicinity of a spot of the fire and gradually towards an evacuation exit, so as to emit smell from the smell-emitting means and thereby giving warning of fire. This enables people without knowledge about an evacuation route in a building or the like to know the evacuation path. Thus, they are guided along the evacuation route. This is effective to reduce damage in case of fire.

In a fire alarm method as set forth in the eighth embodiment, when a fire occurs, emission control means, which is activated based on a signal from fire detection means, activates smell-emitting means that emits an awakening smell so as to emit the smell, and then activates smell-emitting means that emits an irritating smell so as to emit the smell, thereby giving warning of fire. This works to wake up people even if they are sleeping, which is effective for rapid evacuation.

In a fire alarm method as set forth in the ninth embodiment, smell-emitting means are provided along an evacuation route with a space therebetween, and when a fire occurs, emission control means, which is activated based on a signal from fire detection means, controls to activate the smell-emitting means intermittently so as to emit smell such that, in an initial stage of the intermittent operation, emission intervals are long and an emission time period is short, and then as time elapses, the emission intervals are reduced and the emission time period is increased gradually, thereby giving warning of fire. This works to emphasize the degree of danger, which is effective in encouraging evacuees to evacuate rapidly. Moreover, in the initial stage, the emission intervals are made long, and in addition, the emission concentration is made small, that is, the emission time period is made short. Thus, in case of a malfunction of the fire detection means or the like, it is possible to minimize damage to the fire alarm device as well as to the environment.

The invention claimed is:

1. A fire alarm system, comprising:

a plurality of smell-emitting means are provided along an evacuation route with a space therebetween;, emission control means, which is activated based on a signal from fire detection means, means under the condition that a fire occurs; and controls to activate the plurality of smell-emitting means from one of the plurality of smell emitting means located in a vicinity of a spot of the fire and gradually activating at least a portion of the plurality of smell emitting means towards an evacuation exit, so as to emit smell from the smell-emitting means and thereby giving warning of fire.

2. A fire alarm system comprising:

emission control means, which is activated based on a signal from fire detection means under the condition that a fire occurs, activates smell-emitting means that emits an awakening smell, and then activates smell-emitting means that emits an irritating smell, thereby giving warning of fire, the awakening smell and the irritating smell being different in at least one of concentration and chemical composition.

3. A fire alarm system comprising:

a plurality of smell-emitting means are provided along an evacuation route with a space therebetween; and emission control means, which is activated based on a signal from fire detection means under the condition that a fire occurs, controls to activate at least one of the plurality of smell-emitting means intermittently so as to emit smell such that, in an initial stage of the intermittent operation, emission intervals are long and an emission time period is short, and then as time elapses, the emission intervals are reduced and the emission time period is increased gradually, thereby giving warning of fire.

* * * * *